US010569130B2

(12) United States Patent
Ku

(10) Patent No.: US 10,569,130 B2
(45) Date of Patent: Feb. 25, 2020

(54) SQUAT EXERCISER

(71) Applicant: Li-Chen Ku, Taichung (TW)

(72) Inventor: Li-Chen Ku, Taichung (TW)

( * ) Notice: Subject to any disclaimer, the term of this patent is extended or adjusted under 35 U.S.C. 154(b) by 55 days.

(21) Appl. No.: 16/027,377

(22) Filed: Jul. 5, 2018

(65) Prior Publication Data

US 2020/0009421 A1 Jan. 9, 2020

(51) Int. Cl.

| | |
|---|---|
| ***A63B 23/04*** | (2006.01) |
| ***A63B 21/008*** | (2006.01) |
| ***A63B 21/00*** | (2006.01) |
| ***A63B 23/035*** | (2006.01) |

(52) U.S. Cl.

CPC ..... *A63B 23/0405* (2013.01); *A63B 21/0083* (2013.01); *A63B 21/0087* (2013.01); *A63B 21/159* (2013.01); *A63B 21/4034* (2015.10); *A63B 21/4035* (2015.10); *A63B 23/03525* (2013.01); *A63B 2023/0411* (2013.01); *A63B 2208/0228* (2013.01); *A63B 2210/50* (2013.01); *A63B 2225/093* (2013.01)

(58) Field of Classification Search

CPC ..... A63B 21/008–0083; A63B 21/0085–0087; A63B 21/0407; A63B 21/0428; A63B 21/068; A63B 21/4011–4015; A63B 21/4033; A63B 21/4034; A63B 21/4029–4031; A63B 21/4041–4047; A63B 22/0087; A63B 22/0089; A63B 22/0207; A63B 23/035; A63B 23/03516; A63B 23/04; A63B 23/0405; A63B 23/0494; A63B 2023/0411; A63B 2208/0204; A63B 2208/0223; A63B 2208/0228; A63B 2208/0233; A63B 2210/00; A63B 2210/50; A63B 2244/09; A63B 69/04; A63G 13/08; A63G 11/00

USPC ..... 472/106, 110

See application file for complete search history.

(56) References Cited

U.S. PATENT DOCUMENTS

| | | | | |
|---|---|---|---|---|
| 2,825,563 | A * | 3/1958 | Lawton | A63B 22/001 482/112 |
| 5,453,066 | A * | 9/1995 | Richter, Jr. | A63B 21/068 482/57 |
| 5,533,953 | A * | 7/1996 | Lui | A63B 22/0076 482/57 |
| 9,375,607 | B1 * | 6/2016 | Rayman | A63B 23/0405 |
| 10,118,070 | B2 * | 11/2018 | Lin | A63B 21/159 |
| 2017/0252602 | A1 * | 9/2017 | Lefkovitz | A63B 21/068 |
| 2018/0036589 | A1 * | 2/2018 | Lin | A63B 21/068 |

* cited by examiner

*Primary Examiner* — Megan Anderson
*Assistant Examiner* — Kathleen Vermillera

(57) ABSTRACT

A squat exerciser includes a base having a first support and a second support, and an extension is connected to the first support and the second support. Two leg bars extend from two lateral sides of the front end of the extension, and a support bar is connected to the rear end of the extension and located at a distance from the base. A seat is connected with an inner tube which is retractably inserted into an outer tube. A first link and two second links are pivotably connected between a protrusion on the extension and the outer tube. A cylinder is pivotably connected between the extension and a rod connected between the two second links. The height of the seat can be adjusted, and the first and second links and the cylinder can be folded toward the extension.

5 Claims, 8 Drawing Sheets

SQUAT EXERCISER

BACKGROUND OF THE INVENTION

1. Fields of the Invention

The present invention relates to a squat exerciser, and more particularly, to a squat exerciser with a base, an adjustable seat and kg bars, the exerciser is well supported by the base.

2. Descriptions of Related Art

The conventional squat exerciser known to application includes a base with a front part and a rear part which is pivotably connected to the front part. A frame is connected to the front part, and a support member is connected to the rear part. Leg bars are located on the frame and a seat is located on the rear part. The base is designed to be foldable for convenience of storage. However, the strength of the base is weakened due to the pivotal structure of the front part and the rear part. Furthermore, when using the squat exerciser, the user leans on the support member so that the weight will be applied to the pivotal portion between the front part and the rear part, and this specific arrangement may cause the base to shake after a period of time of use.

The present invention is intended to provide a squat exerciser which includes a base with an extension, and the squat exerciser is well supported to eliminate the drawbacks mentioned above.

SUMMARY OF THE INVENTION

The present invention relates to a squat exerciser and comprises a base including a first support and a second support respectively extending upward therefrom. The base further includes an extension connected to two respective tops of the first support and the second support. Two leg bars respectively extend from two lateral sides of the front end of the extension, and a support bar is connected to the rear end of the extension and located at a distance from the base. The base and the support bar are put on the ground. A seat has two handles respectively extending from two sides thereof. The seat is connected to an adjustment unit which includes an inner tube and an outer tube. The seat is connected to the top end of the inner tube, and the bottom end of the inner tube is retractably inserted into the outer tube. A link unit is pivotably connected between the outer tube and a protrusion on the top of the extension. The link unit includes a first link and two second links which are parallel to each other and to the first link. The top end of the first link is pivotably connected to the outer tube by a first pin, and the lower end of the first link is pivotably connected to the protrusion by a first bolt. The top end of each of the second links is pivotably connected to the outer tube by a second pin. The lower end of each of the second links is pivotably connected to the protrusion by a second bolt. The first link is located between the two second links. A cylinder is pivotably connected between the extension and the rod connected between the two second links.

Preferably, the outer tube has a pivotal frame connected to the front side thereof, and the pivotal frame faces the direction toward the protrusion. The first pin pivotably connects the top end of the first link to the pivotal frame. The two second pins pivotably connect the two second links to the two lateral sides of the outer tube. The front side of the outer tube is located between the two lateral sides.

Preferably, a locking member threadedly extends through a nut that is connected to the outer tube, and the locking member is inserted into the outer tube. The inner tube includes multiple holes and the locking member is inserted into one of the holes.

Preferably, the cylinder is a pneumatic cylinder or a hydraulic cylinder.

Preferably, the top end of the first link is separated from the outer tube when the first pin is removed from the top end of the first link. The two second links and the cylinder are pivoted toward the extension. The cylinder and a portion al the outer tube are located between the two second links.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 5:
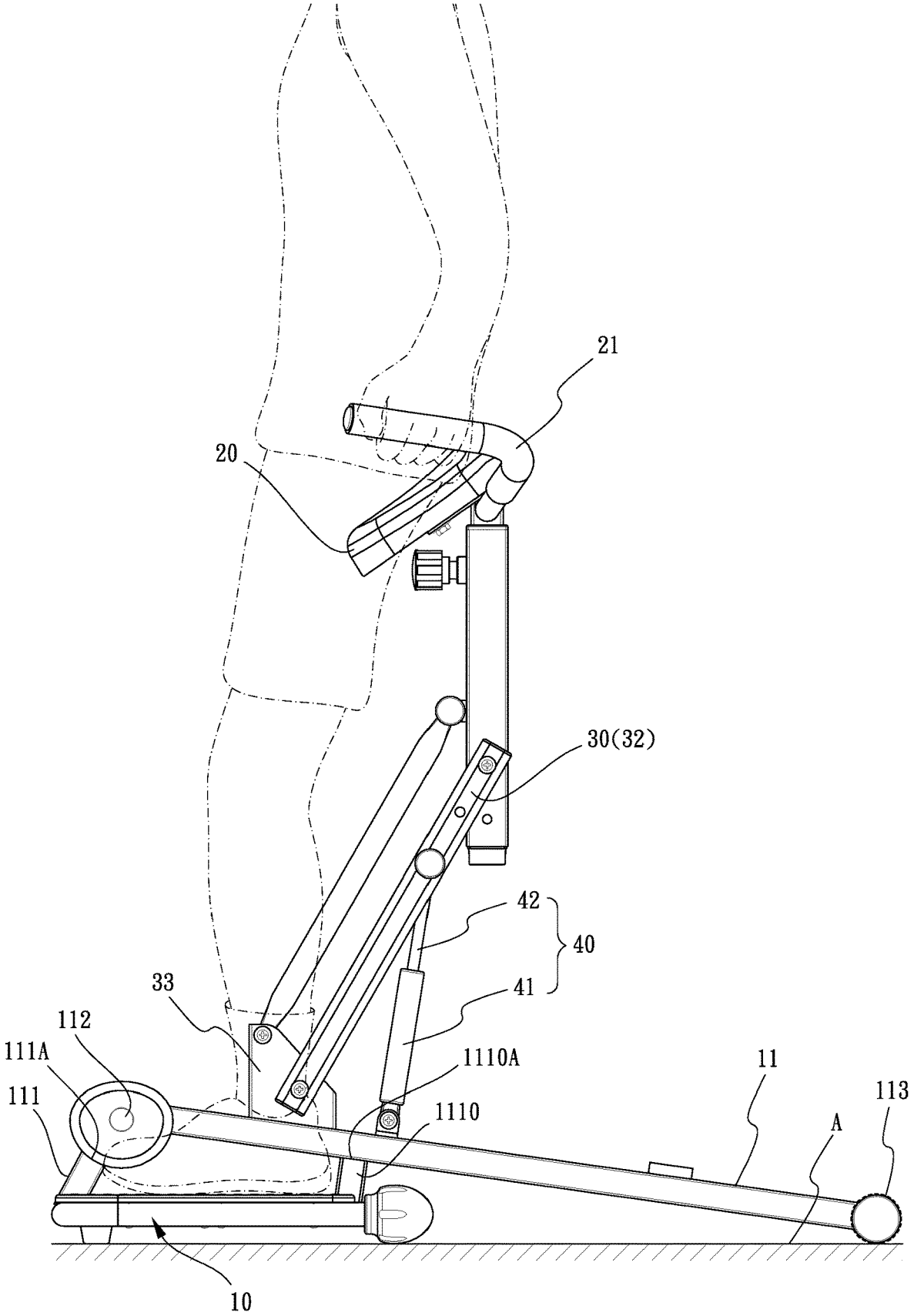
FIGS. 5 and 6 show two operational status of the squat exerciser of the present invention.
Figure 6:
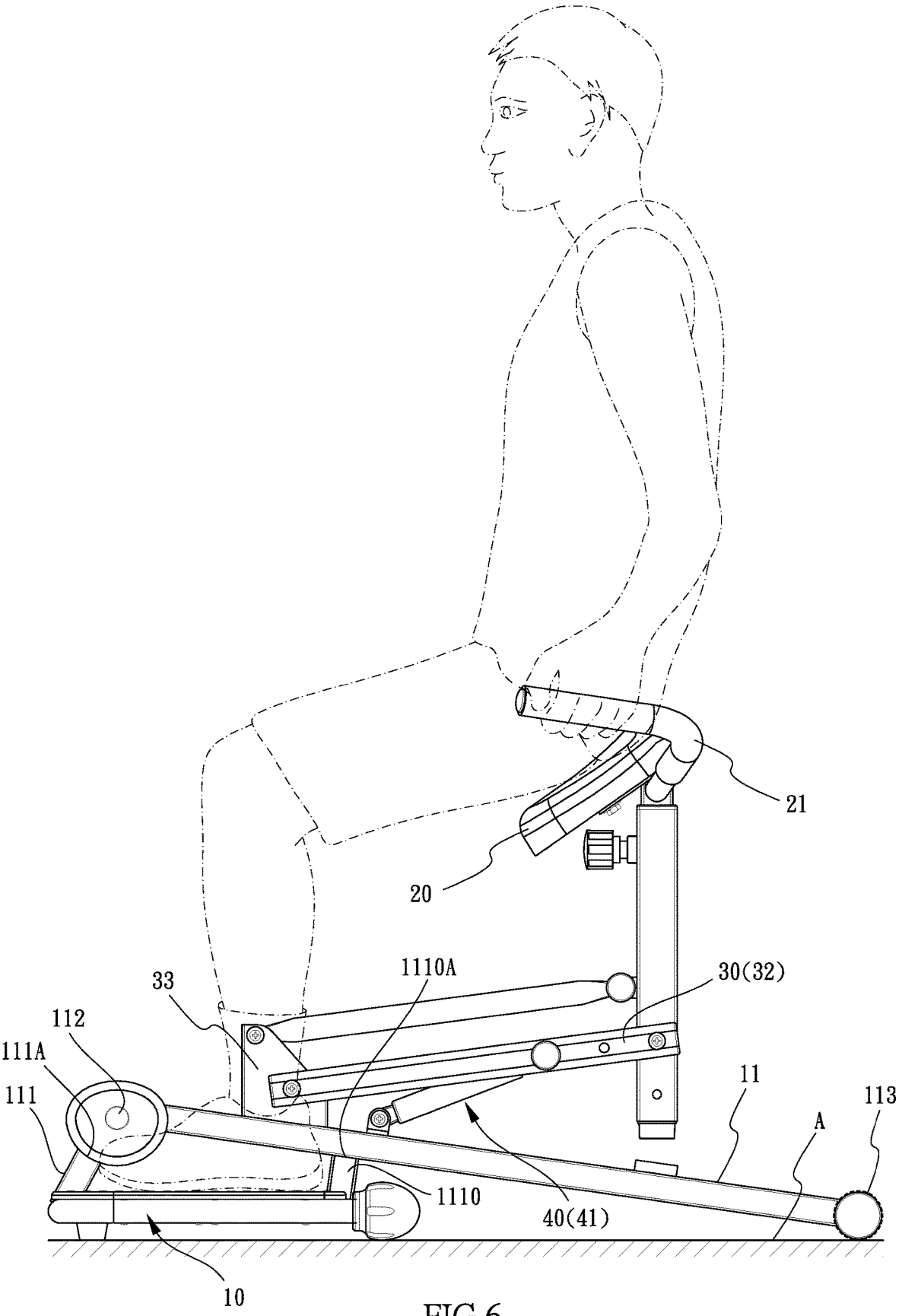

Referring to FIGS. 1 to 4, the squat exerciser of the present invention comprises a base 10 having a first support 111 and a second support 1110 respectively extending upward therefrom. The base 10 further includes an extension 11 that is connected to two respective tops 111A. 1110A of the first support 111 and the second support 1110 as shown in FIGS. 5 and 6. Two leg bars 112 respectively extend from two lateral sides of the front end of the extension 11, and a support bar 113 is connected to the rear end of the extension 11, and located at a distance from the base 10. The base 10 and the support bar 113 are put on the ground "A".

A seat 20 has two handles 21 respectively extending from two sides thereof. The seat 20 is connected to an adjustment unit 22, wherein the adjustment unit 22 includes an inner tube 221 and an outer tube 222. The seat 20 is connected to the top end of the inner tube 221. The bottom end of the inner tube 221 is retractably inserted into the outer tube 222.

Figure 1:
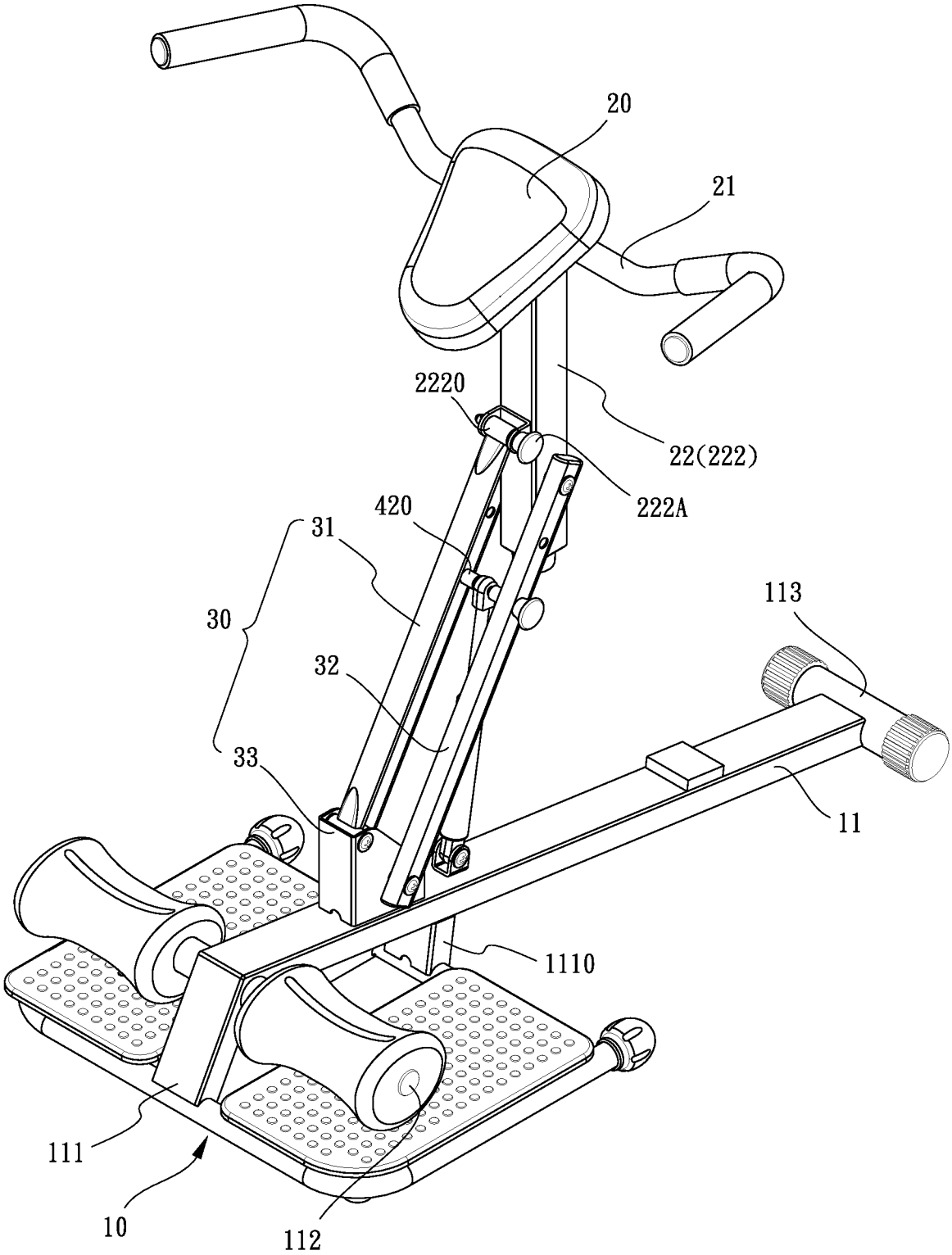
FIG. 1 is a perspective view to show the squat exerciser of the present invention.
Figure 2:
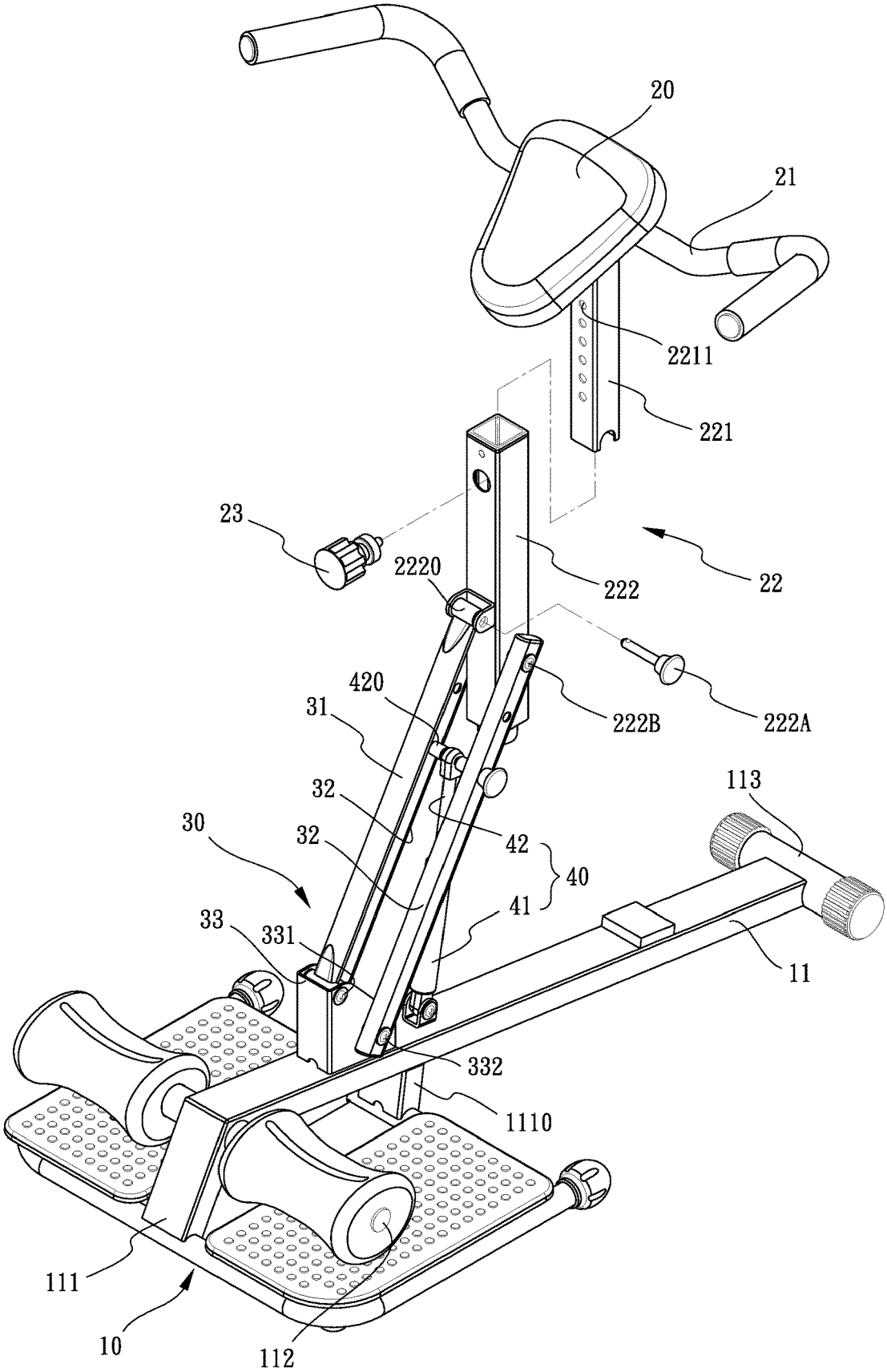
FIG. 2 is an exploded view of the squat exerciser of the present invention.
Figure 3:
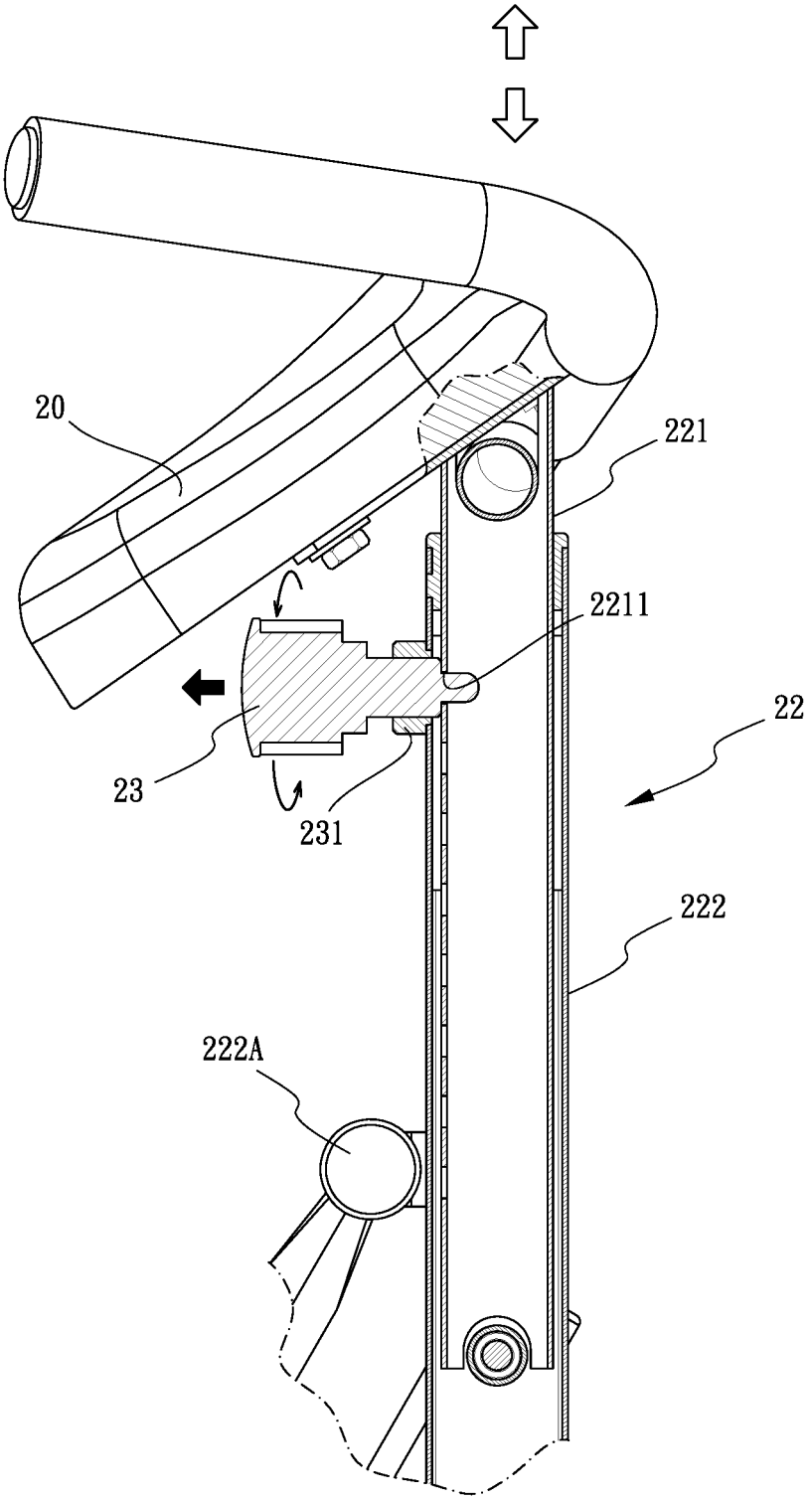
FIG. 3 shows that the locking member is rotated outward to adjust the height of the seat.
Figure 4:
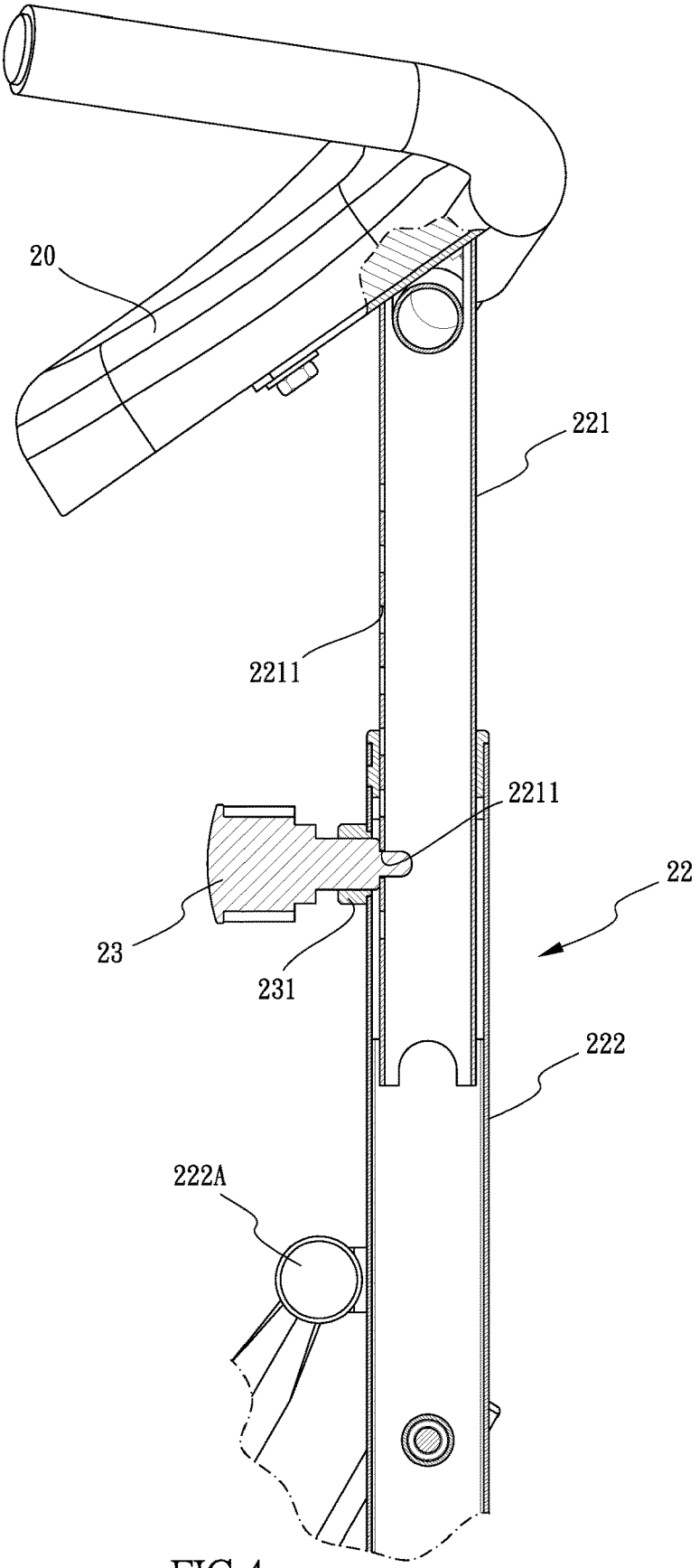
FIG. 4 shows that the locking member is re-located to lift the seat.

A link unit 30 is pivotably connected to the outer tube 222 and the extension 11. Specifically, the link unit 30 includes a first link 31 and two second links 32 which are parallel to each other and to the first link 31. A protrusion 33 is connected to the top of the extension 11. The top end of the first link 31 is pivotably connected to a pivotal frame 2220 connected to the front side of the outer tube 222 by a first pin 222A as shown in FIG. 2. The pivotal frame faces a direction toward the protrusion 33. The lower end of the first link 31 is pivotably connected to the protrusion 33 by a first bolt 331. The top end of each of the second links 32 is pivotably connected to the outer tube 222 by a second pin 222B. The lower end of each of the second links 32 is pivotably connected to two lateral sides of the protrusion 33 by a second bolt 332. The front side of the outer tube 222 is located between the two lateral sides. The first link 31 is located between the two second links 32.

A cylinder 40 includes a case 41 and a piston rod 42, wherein the piston rod 42 is retractably inserted into the top end of the case 41, and the lower end of the case is pivotably connected to the extension 11 and located between the protrusion 33 and the support bar 113. The piston rod 42 is pivotably connected to a rod 420 connected between the two second links 32 as shown in FIG. 2. The cylinder 40 is a pneumatic cylinder or a hydraulic cylinder.

A locking member 23 threadedly extends through a nut 231 that is connected to the outer tube 222, and the locking member 23 is inserted into the outer tube 222. The inner tube 221 includes multiple holes 2211 and the locking member 23 is inserted into one of the holes 2211 to set the height of the seat 20.

When in use, as shown in FIGS. 5 and 6, the squat exerciser is well supported on the ground "A" by the base 10 and the support bar 113. The user sands on the base 10 and sits in the seat 20. The two hands hold the two handles 21, and the two legs contact the under portion of the two leg bars 112. The user then squats downward, the piston rod 42 is retracted and the cylinder 40 supports and buffers the user's weight applied to the link unit 30. When the user lifts his/her bottom, the piston rod 42 extends so that the link unit 30 is pivoted upward, and the seat 20 moves upward. The squat exerciser of the present invention is able to keep the balance of user's body. The squat exerciser is stable and well supported during use.

Figure 7:
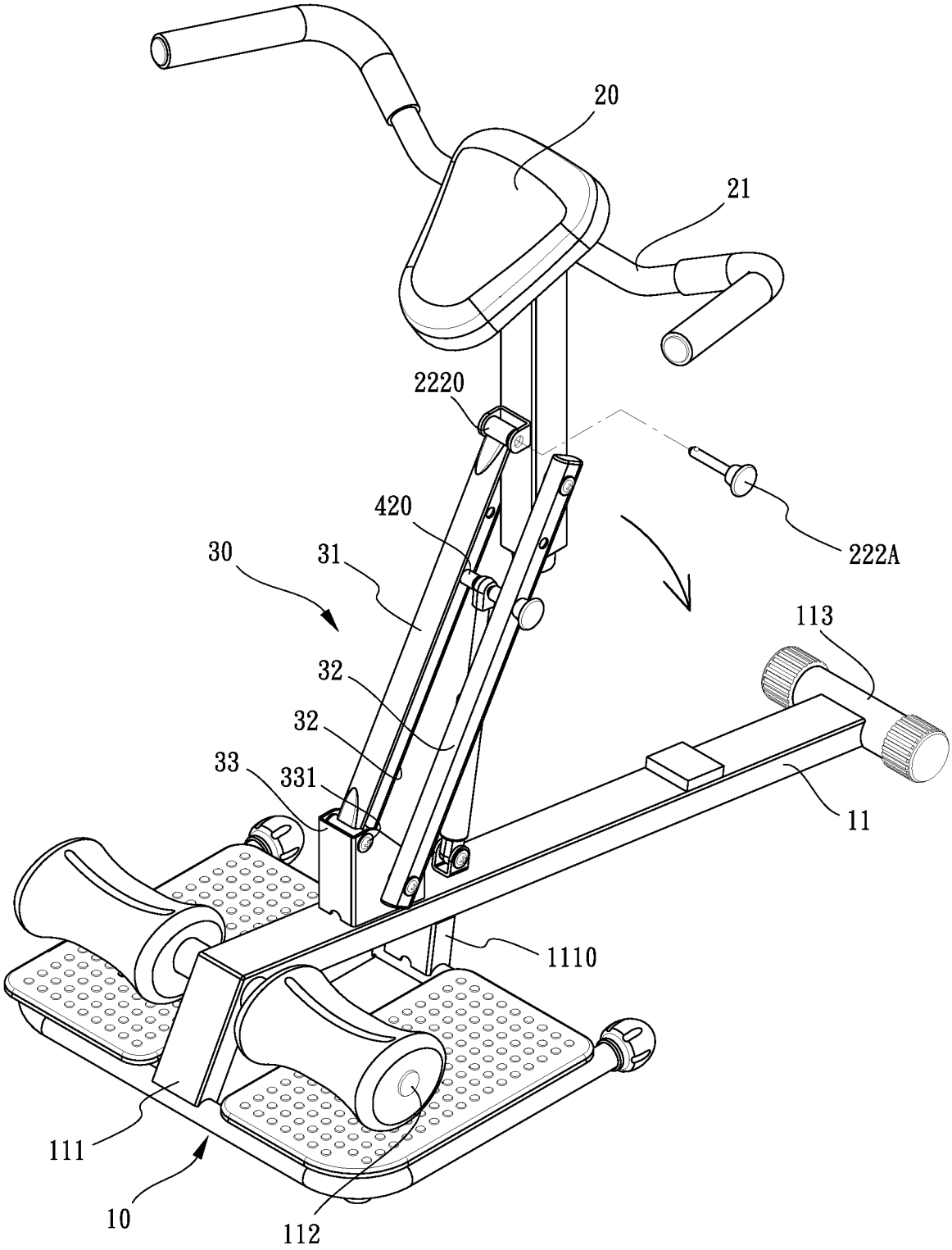
FIG. 7 shows that the first pin is removed from the first link and the pivotal frame on the outer tube to fold the link unit and the seat toward the extension of the base.
Figure 8:
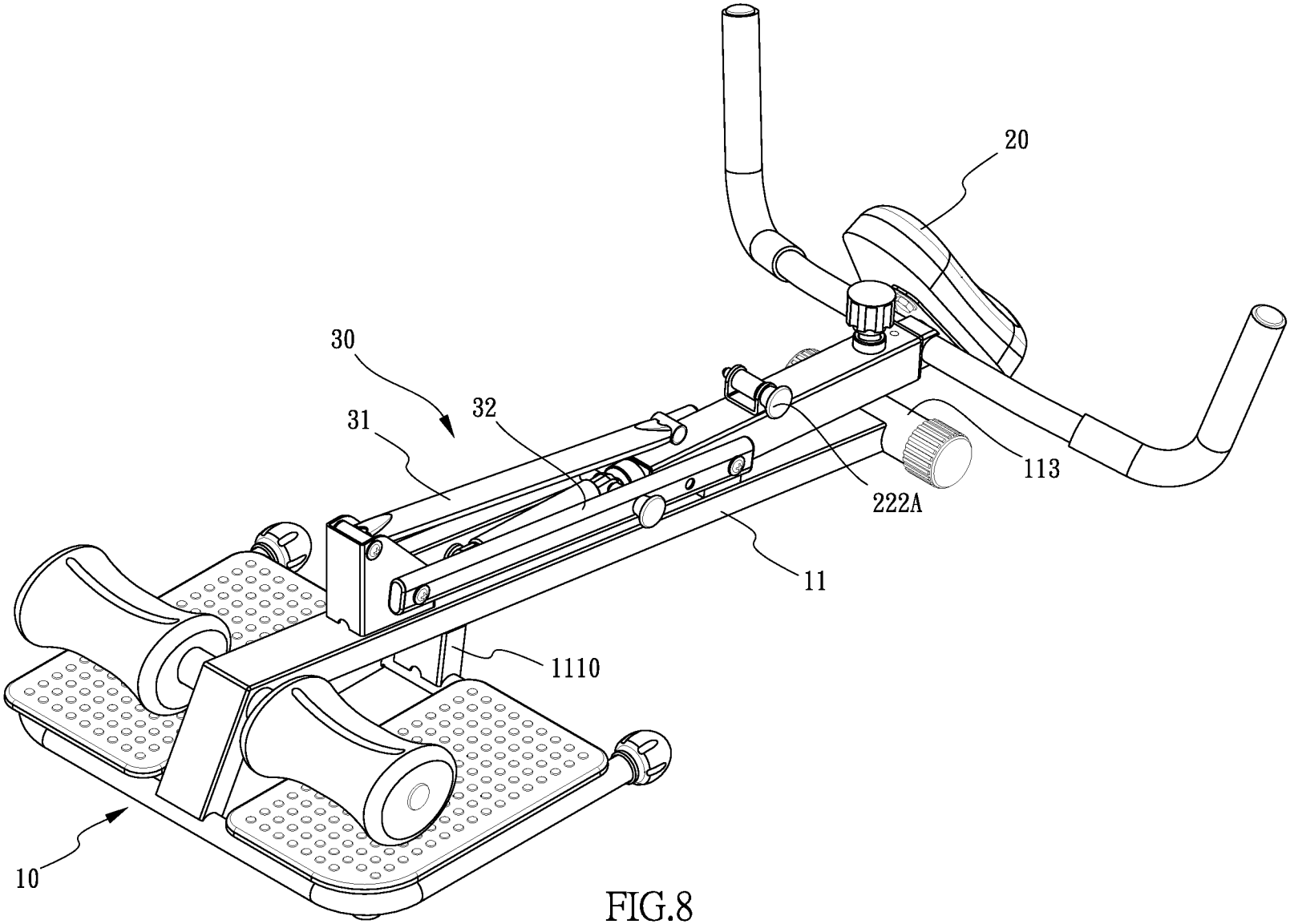
FIG. 8 shows the folded status of the squat exerciser of the present invention.

As shown in FIG. 7, when folding the squat exerciser, the first pin 222A is removed from the top end of the first link 31 and the pivotal frame, so that the top end of the first link 31 can be separated from the outer tube 222. The two second licks 32 and the cylinder 40 are pivoted toward the extension 11, wherein the cylinder 40 and the lower portion of the outer tube 222 are located between the two second links 32. Therefore, the squat exerciser is folded as shown in FIG. 8, and is easily stored.

While we have shown and described the embodiment in accordance with the present invention, it should be clear to those skilled in the art that further embodiments may be made without departing from the scope of the present invention.

What is claimed is:

1. A squat exerciser comprising:

a base having a first support and a second support respectively extending upward therefrom, the base further including an extension connected to two respective tops of the first support and the second support, two leg bars respectively extending from two lateral sides of a front end of the extension, a support bar connected to a rear end of the extension and located at a distance from the base, the base and the support bar adapted to be put on a ground;

a seat having two handles respectively extending from two sides thereof, the seat connected to an adjustment unit, the adjustment unit including an inner tube and an outer tube, the seat connected to a top end of the inner tube, a bottom end of the inner tube retractably inserted into the outer tube;

a link unit including a first link and two second links, wherein the two second links are parallel to each other and to the first link, a protrusion connected to a top of the extension, a top end of the first link being pivotably connected to the outer tube by a first pin, a lower end of the first link being pivotably connected to the protrusion by a first bolt, a top end of each of the second links being pivotably connected to the outer tube by a second pin, a lower end of each of the second links being pivotably connected to the protrusion by a second bolt, wherein the first link is located between the two second links, and a cylinder including a case and a piston rod, the piston rod being retractably inserted into a top end of the case, a lower end of the case pivotably connected to the extension and located between the protrusion and the support bar, the piston rod pivotably connected to a rod connected between the two second links.

2. The squat exerciser as claimed in claim 1, wherein the outer tube has a pivotal frame connected to a front side thereof, the pivotal frame faces a direction toward the protrusion, the first pin pivotably connects the top end of the first link to the pivotal frame, the two second pins pivotably connect the two second links to two lateral sides of the outer tube, and the front side of the outer tube is located between the two lateral sides.

3. The squat exerciser as claimed in claim 2, wherein a locking member threadedly extends through a nut that is connected to the outer tube, the locking member is inserted into the outer tube, the inner tube includes multiple holes, and the locking member is inserted into one of the holes.

4. The squat exerciser as claimed in claim 1, wherein the cylinder is a pneumatic cylinder or a hydraulic cylinder.

5. The squat exerciser as claimed in claim 4, wherein the top end of the first link is configured to separate from the outer tube when the first pin is removed from the top end of the first link, the two second links and the cylinder are configured to pivot towards the extension, and the cylinder and a portion of the outer tube are located between the two second links.

* * * * *